United States Patent [19]

Crawford

[11] Patent Number: 4,521,825

[45] Date of Patent: Jun. 4, 1985

[54] GAS IGNITION CIRCUITS

[75] Inventor: John S. Crawford, Adelaide, Australia

[73] Assignee: Technical Components Pty. Ltd., Hendon, Australia

[21] Appl. No.: 542,858

[22] Filed: Oct. 17, 1983

[30] Foreign Application Priority Data

Oct. 20, 1982 [AU] Australia ..... PF6437

[51] Int. Cl.[3] ..... F23Q 3/00; F23Y 2/28

[52] U.S. Cl. ..... 361/253; 431/264

[58] Field of Search ..... 361/253; 431/258, 264

[56] References Cited

U.S. PATENT DOCUMENTS 3,889,160 6/1975 Cobarg ..... 431/264 X
4,023,922 5/1977 Goto ..... 431/264
4,329,628 5/1982 Bohan ..... 431/264 X
4,404,616 9/1983 Miyanaka et al. ..... 361/253

*Primary Examiner*—Donald A. Griffin
*Attorney, Agent, or Firm*—Townsend and Townsend

[57] ABSTRACT

Circuit arrangements for use in the generation of sparks for igniting gas at a gas burner assembly whereby the operation is controlled electrically by means of an electronic control circuit which reacts to the presence or absence of a gas flame. The circuit comprises a charging circuit for a charge storage capacitor, a spark output transformer, an SCR switching device for discharging the charge stored in the capacitor and a non-linear conductive element connected between the anode and the gate of the SCR. Therefore when the anode voltage reaches the required value a trigger signal is applied via said non-linear conductive element to the gate to trigger the discharge of the capacitor by the SCR.

9 Claims, 8 Drawing Figures

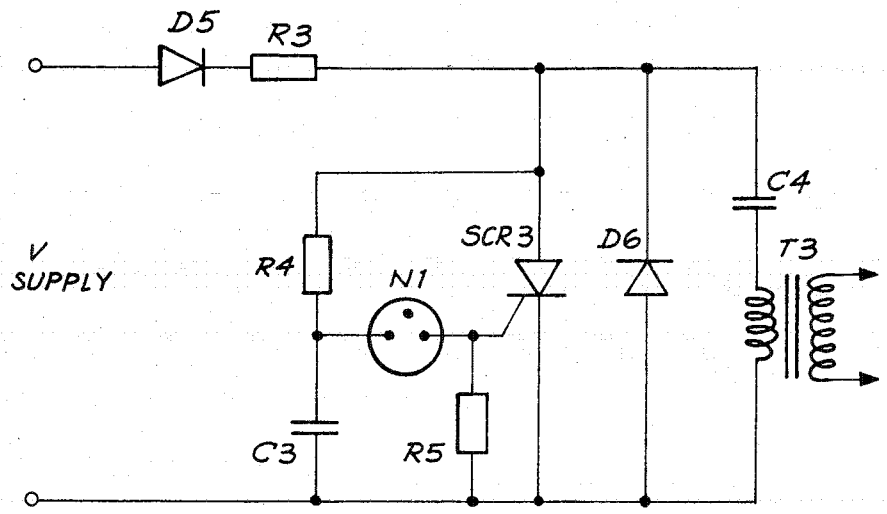
FIG. 3
FIG. 4
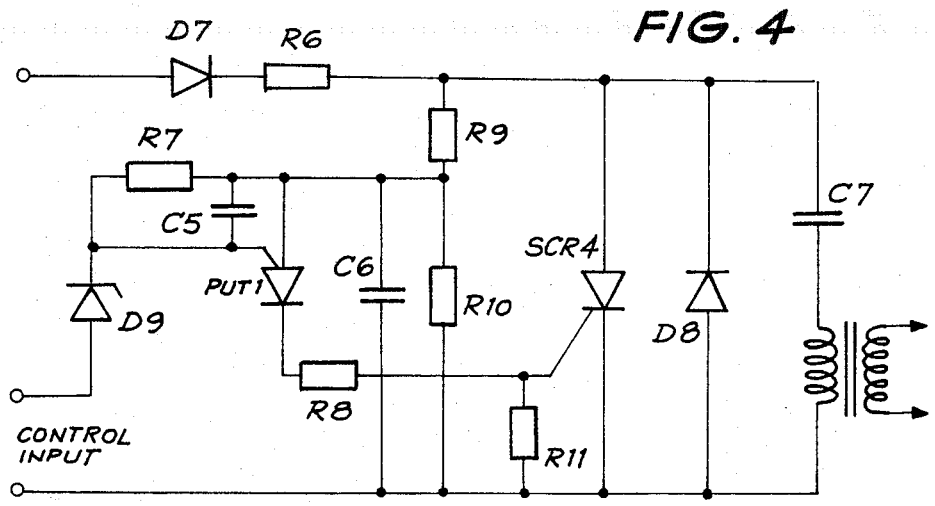

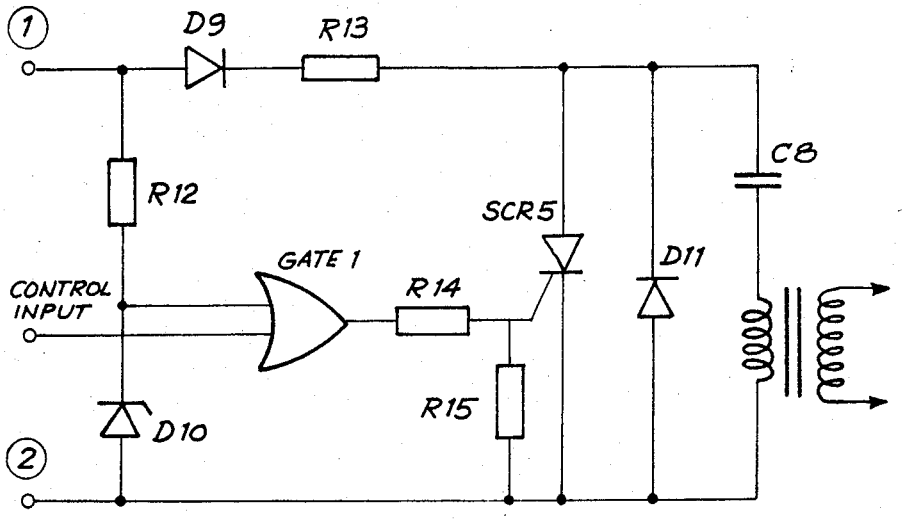
FIG. 5
FIG. 6
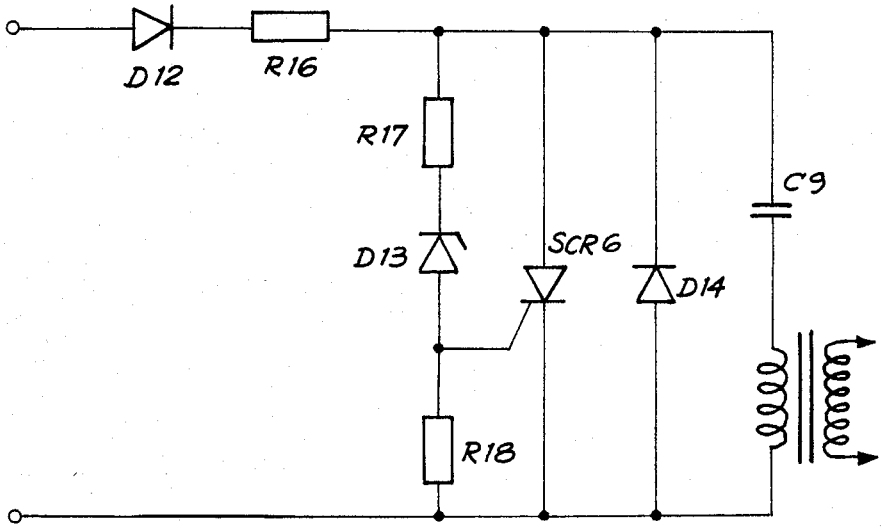

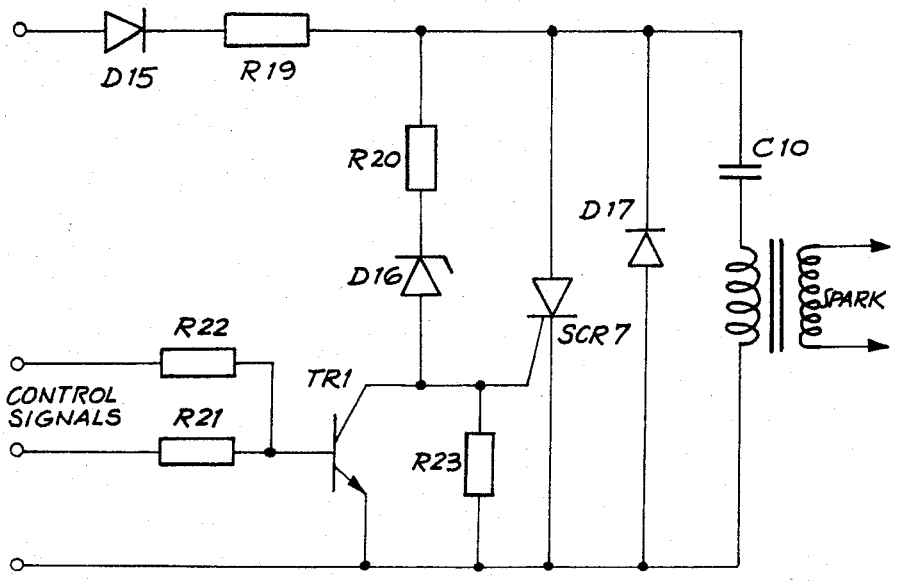
FIG. 7
FIG. 8
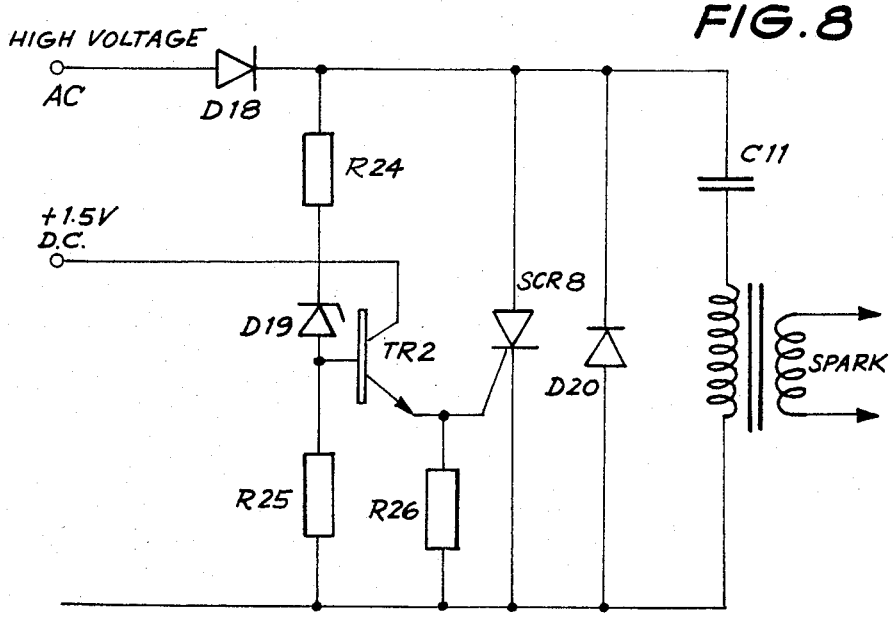

GAS IGNITION CIRCUITS

The present invention relates to circuit arrangements for use in the generation of sparks for the purpose of igniting gas at a gas burner assembly. It is also very suitable for its operation to be controlled electronically in applications where an electronic control circuit is required to react to the presence or absence of a gas flame.

BRIEF DESCRIPTION OF THE DRAWING FIGURES

FIGS. 1 to 5 show conventionally known prior art electronic gas ignition circuits.

FIGS. 6 to 8 show the electronic gas ignition circuit of the invention.

THE PRIOR ART

Spark generation circuits are well known and in one circuit commonly used, a charge storage capacitor is charged to the required voltage when it is then discharged using a Silicon Controlled Rectifier through the primary winding of a transformer. By induction a high voltage is produced in the secondary of the transformer.

The circuit arrangement in accordance with this invention is applicable both in the application of a simple ignition device such as that used in a domestic cooker where multiple spark outlets are provided to give ignition at each burner or in more complex automatic systems where the flame is monitored electronically and the flow of gas is controlled by electronic means as well. In this case on establishment of the flame the spark circuit, must be inactivated electronically.

Figure 1:
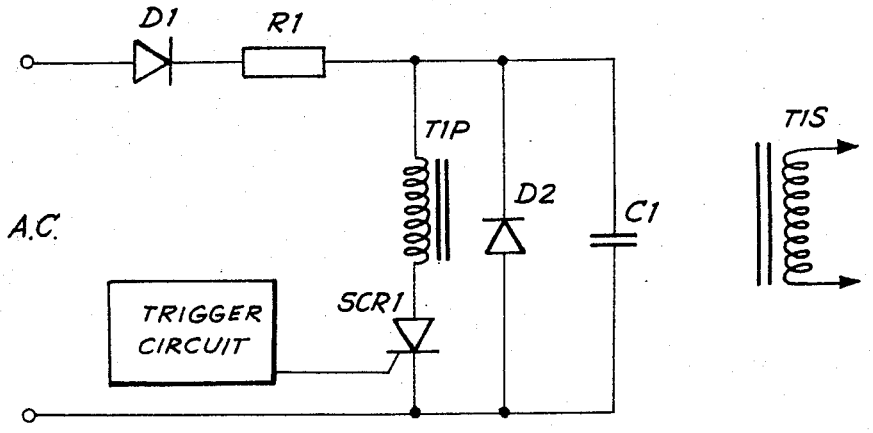
Figure 2:
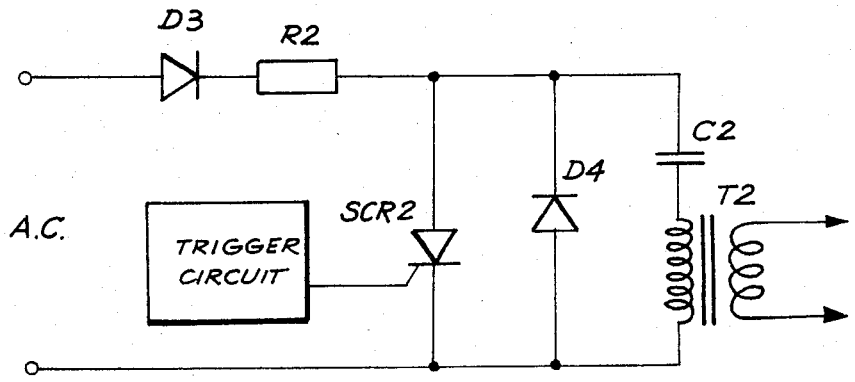

Two variations of the basic spark generation circuit are shown in FIG. 1 and FIG. 2. These have for example been described in Australian patent application No. PE5752 and are similar to the circuit described in Australian Pat. No. 493722 and its USA counterpart U.S. Pat. No. 3,887,864.

In FIG. 1, D1 and R1 provide the DC charging current. Diode D1 half-wave rectifies the supply signal. R1 limits the peak charging current and also provides a current limiting function should the spark SCR fail and become short circuit. In particular the SCR is highly stressed during the generation of the spark where the current rise can be extremely rapid, typically of the order of 50 amps per microsecond and reaches a peak value typically above 100 amps.

CI is the charge storage capacitor which is discharged by SCR1, when it is triggered by the trigger circuit, applying a large current pulse in the primary of the spark transformer TIP. By suitable choice of the turns ratio of the transformer a high voltage as high as 20 kilovolts is generated at the spark outlets of the transsformer secondary TIS. D2 is a flywheel diode and is not always needed. However as SCR1 acts as the discharge in a series inductance and capacitive circuit the discharge of C may be considerable FIG. 2 shows the simple variation to the circuit where the capacitor C2 and the transformer primary T2 are connected in series the capacitor being both charged and discharged via the transformer primary. In this circuit D4 is again a flywheel diode and enhances the spark by conducting during the negative part of the series resonant discharge which would otherwise reverse bias SCR2.

Design considerations for this section of the circuit require consideration of the energy required in the spark. It is well known that if the spark energy is below a certain limiting level it will be inadequate to ignite gas. With allowance made for losses in the transformer and the SCR, the energy available is $1/(2CV^2)$; where C is the capacitance used for charge storage C2, and V the voltage to which the capacitor is charged at the time of sparking. A typical value for C2 is between 0.68 and 2.2 microfarads and care must be taken that the capacitor can handle the high peak current it must supply. Operating from a 240 volt 50 HzAC supply a typical value of R2 is 500 ohms. In one half cycle C2 of 0.68 microfarads is charged to 250 V DC ready for the spark discharge at 50 Hz. From 240 V the peak value attained by C2 is approximately 340 V if the SCR2 is not triggered. For slower spark rates R2 can be increased to charge C2 more slowly.

A common trigger circuit uses a neon gas discharge tube to provide a firing pulse in the gate circuit at a frequency determined by an RC network connected to the gate via the neon discharge tube as shown in FIG. 3. In this circuit C3 is charged via R4 to generate a time delay. When the voltage across C3 reaches the breakover voltage of the neon tube N1 the neon conducts discharging C3 into the gate of the SCR3 to trigger it.

Electronic control can be obtained by applying a conductive path across C3 to prevent it charging to a sufficient voltage to fire the neon and hence the SCR.

An alternative circuit using a programmable unifunction circuit has been described in Australian patent application No. PE5752. This trigger circuit is shown in FIG. 4.

In this circuit the firing of the PUT is controlled by an external pulse control input which may only fire the PUT when capacitor C6 has charged to a sufficient voltage for zener diode D9 to conduct and fire PUT1.

A further example which illustrates the manner in which the SCR can be triggered synchronously at 50 Hz using C-MOS logic integrated circuits is shown in FIG. 5. Gate 1 is a 2 input NOR gate in which if either of its two inputs is high then the output is low. Thus if the control input is high the gate output is low and no signal is applied to trigger the spark SCR. However if the control signal is low the spark circuit is enabled and operation is as follows: The mains supply voltage applied to terminal 1 with respect to terminal 2 will during the positive half cycle charge the spark capacitor C8 via D9 and R13. Also via R12 and zener diode D10 a positive or high input will be applied to the NOR gate forcing the output low and preventing triggering of the SCR 5.

However, in the negative half cycle, C8 has been charged and as both inputs to the gate are low the gate output goes high driving the SCR gate via R14 and generating a spark. The energy required to drive the SCR gate is derived from the power supply of the gate which is not shown.

Two disadvantages have been found with circuits of this kind. First that dissipation in R13 is excessive should the spark SCR 5 become short circuit and second that while the spark circuit is disabled by the control input, C8 will charge up to the full peak value of the supply applying further stress to the SCR when a spark is required. It has the advantage of requiring a control input of a kind which may already be available from the logic and timing analysis circuit required for flame monitoring and control.

The spark repetition rate of 50 Hz synchronzied to the electrical supply gives a rapidly repeated spark for effective ignition, but has relatively high power dissipation while sparking and can create radio and television interference.

The earlier mentioned circuit using neon discharge circuits (FIG. 3) have an advantage that adjustment of the RC charging rate can give control of the spark repetition frequency, but also are difficult to control in that the voltage levels and the impedances associated with such control circuits do not lend themselves to simple electronic control. Hence the adoption of the circuit in FIG. 4 using a programmable unijunction transistor.

SUMMARY OF THE INVENTION

The circuit arrangement in accordance with the invention comprises a charging circuit for the charge storage capacitor, the spark output transformer, an SCR switching device for discharging the charge stored in the capacitor and a non-linear conductive element connected from the anode to the gate of SCR so that when the anode voltage reaches the required value a trigger signal is applied via said non-linear conductive element to the gate to trigger the discharge of the capacitor by the SCR.

An arrangement by which the charge storage capacitor can be charged to a suitable voltage to give adequate spark energy to ignite the gas or other fuel.

The SCR (Silicon Controlled Rectifier) switching device having three electrodes, the anode, the cathode and the gate electrode with a circuit arrangement to provide a trigger signal to the gate when the charge storage capacitor is adequately charged by means of a non-linear conductance connected between the anode and the gate of the SCR switching device. This non-linear conductance is such that negligible current flows until the voltage across it approaches that at which spark discharge is desired. This trigger signal being derived from the charging current being supplied to charge the charge storage capacitor.

This circuit arrangement overcomes a number of problems associated with previously known SCR spark generating circuits and in particular will result in improved reliability and more stable performance.

DESCRIPTION OF PREFERRED EMBODIMENTS

The non-linear conductance can be a zenn diode of a suitable breakdown voltage with or without a resistor in series a voltage dependent resistor or a flywheel diode.

Further a resistor can be included between the gate and cathode of the SCR to prevent premature switching ON of the SCR due to leakage current or currents in the non-linear conductance which through normally negligible are temperature dependent in the reverse manner to gate sensitivity of the SCR and exceed the SCR threshold thus firing it prematurely.

The circuit arrangement in accordance with an embodiment of the present invention is shown in FIG. 6. The limitations of circuits currently used and problems of reliability and power dissipation has prompted an investigation into alternative triggering arrangements. In investigating these circuits we have discovered that the circuit arrangement of FIG. 6 provides a number of advantages.

In this circuit the sparking rate is set by R16 and C9 giving a charging time constant whereby SCR6 is fired when the voltage on C9 reaches a predetermined value. This firing point for SCR6 is set by means of the non-linear conductance made up in this case of R17 and D13, a series combination of a resistor and a zener diode. R18 is chosen such that the voltage drop across it remains below the minimum voltage needed to fire SCR6 until C9 has been charged to the required firing voltage. The non-linear conductance made up of R17 and D13 is such that when the voltage on C9 reaches the predetermined voltage its conductance increases sufficiently to allow the voltage developed across R18 to fire SCR6.

Typical components used in such a circuit are as follows:

Diode D12: IN4007
Resistor R16: 22,000 ohms
Resistor R17: 1,000 ohms
Zener diode D13: Philips 240 volt. BZT 03 C240
Resistor R18: 1,000 ohms
SCR 6: Unitrode 2N6683
Silicon controlled rectifier
Diode D14: IN4007
Capacitor C9: 0.68 MF. 250 Volt
Transformer. Ferrite rod core
Primary turns: 30
Secondary turns: 3000

FIG. 6 Component values

The circuit has been found to operate without R17, R18 and D14 although as explained earlier there is an improvement when D14 is used as the flywheel diode. R18 is felt to be needed at elevated temperatures to prevent premature firing of the SCR due to leakage currents in the non-linear conductance D13.

During the spark discharge it was found that D13 can be forward biased and inject an excessive current pulse into the gate of the SCR and R17 serves to limit this current. Other non-linear electronic components could be used in place of the zener diode D13, such as for example a voltage dependent resistor which would have a similar voltage current characteristic to the series combination of R17 and D13. It has been found that the value of R17 is non-critical and can be varied from a few ohms to some tens of kilohms without affecting the performance of the circuit.

The advantages of this circuit include the use of R16 and C9 as an RC time constant to provide the spark repetition timing for the circuit. This means a considerably larger value of R16 can be used greatly reducing the power dissipation while sparking and in the event of SCR6 becoming short circuit.

Another advantage is that when sparking is prevented by the electronicl control circuit shown in FIG. 7 C9 will not continue to charge above 240 V but will be held at this voltage, current that would otherwise charge C9 to higher voltage being conducted to the common rail via R17,D13 and the control transistor TR1. Thus every spark is produced with the same voltage on C9 and the operation of C9 for extended periods above 250 volts is avoided.

In FIG. 7 the saturation of the transistor TR1 while it is held ON to prevent SCR7 from firing will be well below the typically 100 millivolt published limit which is the gate voltage below which the SCR is guaranteed not to fire.

Although this circuit is more complex than a number of alternative circuits the advantages given above and the expected gain in reliability will outweight this added complexity and make it a worthwhile improvement.

In particular this circuit is very well suited to replace that shown in FIG. 4 where a more regular spark rate also results, in the circuit of FIG. 7 there only being the one RC time constant of R19 and C10.

Some minor variation of the spark rate may result if the 20 millisecond repitition rate of the input sine wave means that the spark rate varies by an integral multiple of 20 milliseconds depending on whether a given half wave of the input signal succeeds in firing the output circuit or not.

FIG. 7 also shows the convenient manner in which the spark circuit can be held off. If either control signal input is held high TR1 is switched ON and sparking cannot occur. Such an or function is commonly required in a gas ignition controller where flame presence, or the preignition purge time or the time which indicates the failure of the burner to ignite within the prescribed attempted ignition time all can be obtained within the control circuit and applied to TR1 in such a logical NOR function as is shown via R21 and or R22 etc.

In some cases the current available may not be sufficient to positively trigger the discharge SCR. Although sufficient current may be available to charge the discharge capacitor, the further 0.5 mA needed to trigger the gate of a sensitive SCR over the full range of operating temperatures may not be available and the circuit would fail to trigger the SCR. Such a circuit is that described in Australia Patent (patent application No. 28376/77).

In this circuit a blocking oscillator inverter is used to provide the discharge energy at over 200 volts from a 1.5 volt supply. To save battery power the oscillator can be switched off and is only permitted to operate in the absence of a flame or to maintain a sufficient voltage to sense the flame presence. Thus while sparking a current of some 300 mA is drawn from the 1.5 volt battery and this current falls to an average of 5 microamps while the controlled oscillator is monitoring the flame presence. In such a circuit limited current is available at 200 volts to trigger the SCR. FIG. 8 shows how a transistor can be used to amplify the current available from the non-linear conductive element made up of R24 and D19.

Some spark generating circuits are used which employ gas discharge devices as the current switching element. Apart from giving lower energy transfer efficiency from the energy stored in the charge storage capacitor to the energy finally available in the spark such circuits do not lend themselves to electronic control. Thus circuit 3 and circuit 4 used a voltage sensitive trigger which switches to a highly conductive state once a given voltage is attained across the trigger element. This provides a pulse to drive the SCR gate. The breakover voltages of such trigger devices are unsuitable for their direct use in a spark circuit and also the impedances and breakover currents are such that effective electronic control is difficult especially where the requirement of a spark by the control circuit must wait until the charge storage capacitor has reached a sufficient voltage to provide the necessary stored energy to be adequate to successfully ignite the gas.

The advantages provided by this invention include the fact that by presenting a DC firing signal to the gate control is easy and the design becomes a simple balance between the DC conditions present in the circuit at the time sparking is required.

Certain modifications and variations will suggest themselves to those skilled in these arts. Accordingly it is not intended that the scope of the invention should be limited by the drawings or their description.

I claim:

1. A circuit for generating a spark to ignite a gas or other fuel burner, comprising:

a charging circuit;

a charge storage capacitor coupled to said charging circuit;

a spark output transformer connected in series with said capacitor;

an SCR switching device connected in parallel to said capacitor and transformer for discharging the charge stored in the capacitor; and a non-linear positive resistance conductive element connected from the anode to the gate of said SCR;

so that when the anode voltage reaches the required value a trigger signal is applied via said non-linear conductive element to the gate of said SCR to trigger the discharge of the capacitor by the SCR, whereby said triggering is effected by said SCR without requiring an additional triggering device.

2. A circuit as claimed in claim 1 wherein the non-linear conductive element comprises a zener diode of a suitable breakdown voltage.

3. A circuit as claimed in claim 2 wherein the non-linear conductive element includes a resistor in series with the zener diode.

4. A circuit as claimed in claim 3, further comprising a transistor having a collector coupled to the gate of said SCR, an emitter coupled to the cathode of said SCR and a gate adapted to receive a control signal for electronically controlling the operation of said spark generating circuit.

5. A circuit as claimed in claim 3, further comprising a transistor having a collector coupled to a D.C. supply voltage, an emitter coupled to the gate of said SCR and a base coupled to said zener diode, thereby amplifying the current flowing through said zener diode to the gate of said SCR.

6. A circuit as claimed in claim 1 wherein the non-linear conductive element is a voltage dependent resistor (VDR).

7. A circuit as claimed in claim 1, further comprising a resistance coupled between the gate and the cathode of the SCR, whereby premature switching ON of the SCR due to leakage current or currents in the non-linear conductance range of the SCR are inhibited.

8. A circuit as claimed in claim 1, further comprising a flywheel diode connected across one of the SCR and the capacitor.

9. A circuit for generating a spark to ignite a fuel burner, comprising:

a charging circuit;

a capacitor coupled to said charging circuit;

a spark output transformer connected in series with said capacitor;

an SCR switching device for discharging said capacitor connected in parallel with said capacitor and transformer;

a flywheel diode connected in parallel with said SCR, having its cathode connected to the anode of said SCR;

a zener diode;

a first resistor in series with said zener diode, said zener diode and first resistor being connected between the gate and anode of said SCR; and a second resistor connected between the gate and the cathode of said SCR;

so that when the SCR anode voltage reaches the required value a trigger signal is applied via said zener diode and first resistor to the gate of said SCR thereby turning on the SCR and discharging the capacitor, whereby said SCR acts as a triggering device thereby eliminating the need for an additional triggering device.

* * * * *